US005823685A

United States Patent [19]

Garlichs

[11] Patent Number: 5,823,685

[45] **Date of Patent: *Oct. 20, 1998**

[54] PEEL-AWAY CLOSURE FOR A BAG

[75] Inventor: Dietmar Garlichs, Wetter, Germany

[73] Assignee: Ardex Inc., Coraopolis, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 715,555

[22] Filed: Sep. 19, 1996

[51] Int. Cl.[6] ..... B65D 33/18

[52] U.S. Cl. ..... 383/211; 383/78; 383/906

[58] Field of Search ..... 383/47, 48, 55, 383/56, 78, 125, 210, 211, 906, 61, 62, 50, 52, 203, 204; 229/247, 248, 249, 212, 213, 214

[56] References Cited

U.S. PATENT DOCUMENTS

| | | | |
|---|---|---|---|
| 2,197,490 | 4/1940 | Williams et al. | 383/203 X |
| 2,327,024 | 8/1943 | Davidson, Jr. et al. | 383/211 X |
| 2,349,247 | 5/1944 | Coghill | 383/210 X |
| 2,406,791 | 9/1946 | Belcher | 393/78 X |
| 2,678,154 | 5/1954 | Borchardt et al. | 383/211 X |
| 2,765,974 | 10/1956 | Phipps et al. | 383/906 X |
| 2,948,457 | 9/1960 | Thiele | 383/906 X |
| 3,237,534 | 3/1966 | Lissner . | |
| 3,259,507 | 7/1966 | Smith | 383/211 X |
| 3,327,925 | 6/1967 | Coker | 383/906 X |
| 3,591,072 | 7/1971 | Sannino . | |
| 3,926,311 | 12/1975 | Laske . | |
| 3,938,659 | 2/1976 | Wardwell . | |
| 3,979,049 | 9/1976 | Achelpohl . | |
| 4,997,289 | 3/1991 | Sasaki et al. | 383/55 X |

FOREIGN PATENT DOCUMENTS

| | | | |
|---|---|---|---|
| 1008100 | 5/1957 | Germany | 383/48 |
| 1206787 | 12/1965 | Germany | 383/48 |
| 432821 | 8/1935 | United Kingdom | 383/48 |

*Primary Examiner*—Jes F. Pascua
*Attorney, Agent, or Firm*—Alan G. Towner; Eckert Seamans Cherin & Mellott, LLC

[57] ABSTRACT

A bag closure is provided for containing flowable material such as powdered cement and mortar. The closure includes loosely folded, overlapping end flaps which are secured together by an overlying peel-away sheet. Where the bag is to be filled with moisture sensitive materials, the peel-away sheet is preferably impermeable to water vapor and forms a vapor barrier closure. The peel-away sheet, which preferably controls the moisture content within the bag during storage, includes a graspable tab that is used to peel the sheet at least partially away from the loosely folded flaps of the bag. An end tuck of the bag may then be unfolded to provide a pour spout for the contents of the bag. The closure eliminates the need for prior art pull strings or sewn ends which are not easy to open and which do not adequately resist moisture penetration.

26 Claims, 3 Drawing Sheets

PEEL-AWAY CLOSURE FOR A BAG

BACKGROUND OF THE INVENTION

1. Field of the Invention

The present invention relates to a bag for containing materials, and more particularly relates to a peel-away bag closure which can be at least partially removed from the bag to allow its contents to be poured. The bag may hold moisture sensitive materials such as powdered cement, mortar and the like.

2. Background Information

Various types of bags have been used to hold flowable materials such as cement, patching material, fertilizer and the like. The bags typically include closures such as pull strings or sewn ends which, while keeping the bag closed in order to prevent the material from spilling out, are not easily operable and often result in tearing of the bag to get it open. Furthermore, such closures do not resist entry of moisture and do not provide a suitable protective vapor barrier.

U.S. Pat. No. 3,591,072 to Sannino discloses a leak proof bag formed from a flat tube of sheet material having non-overlapping folded end flaps. A strip of tape is applied over the folded ends such that the tape contacts the free edges of the flaps. This non-overlapping configuration provides a permanent closure in which the tape absorbs outwardly acting forces in order to prevent rupture of the bag.

U.S. Pat. No. 3,979,049 to Achelpohl discloses a cross-bottom bag having overlapping end flaps which are permanently sealed together by a heat-meltable material. A cover sheet is attached to the bottom of the bag using strips of heat-meltable material which contact the heat-meltable strips previously applied to the folded flaps. By securing the flaps together and then attaching a cover sheet, a permanent closure is provided for the bottom of the bag.

Despite the widespread use of various types of bags for flowable materials, a need still exists for a bag which permits easy opening and pouring of the contents of the bag, and which may also provide adequate control of moisture content during storage.

SUMMARY OF THE INVENTION

The present invention relates to bags adapted to contain flowable materials such as granular materials which must have the moisture content controlled during storage. The invention includes a combination of loosely folded flaps at an end of the bag, coupled with an overlying adhesively-secured peel-away sheet which has a non-adhered tab portion. The closure may be opened by grasping the non-adhered tab and pulling it back to where the flaps unfold to form a pour spout. Where the bag is to contain moisture sensitive materials, the peel-away sheet is preferably made of a vapor-barrier material.

An object of the present invention is to provide a bag for containing a flowable material. The bag may include a tubular sidewall, a pair of oppositely disposed inwardly folded corner tucks at an end of the sidewall, a pair of oppositely disposed inwardly folded overlapping side flaps at the end of the sidewall lying adjacent the corner tucks, and a peel-away sheet removably secured to the corner tucks and side flaps. The peel-away sheet includes a graspable tab portion adjacent one of the corner tucks which may be grasped and peeled away from the corner tuck to allow the corner tuck to be unfolded to open the bag.

Another object of the present invention is to provide a bag closure for a flowable material including an inwardly folded corner tuck at an end of the bag, a pair of oppositely disposed inwardly folded overlapping side flaps at the end of the bag lying loosely adjacent the corner tuck, and a peel-away sheet removably secured to the corner tuck and side flaps.

Another object of the present invention is to provide a method of forming a bag closure including the steps of providing a tubular sidewall, folding an end of the tubular sidewall to form a pair of oppositely disposed inwardly extending corner tucks loosely adjacent a pair of oppositely disposed inwardly extending overlapping side flaps, adhering a peel-away sheet to the corner tucks and side flaps to temporarily secure the corner tucks and side flaps in a folded position, and providing the peel-away sheet with a graspable tab portion adjacent one of the corner tucks.

Another object of the present invention is to provide a method of opening a bag including the steps of providing a bag with a closure having a peel-away sheet, grasping the peel-away sheet, peeling the sheet away from a corner tuck of the bag, and unfolding the corner tuck to form an opening in the bag.

These and other objects of the present will become more readily apparent from the following description.

DESCRIPTION OF THE PREFERRED EMBODIMENTS

Figure 1:
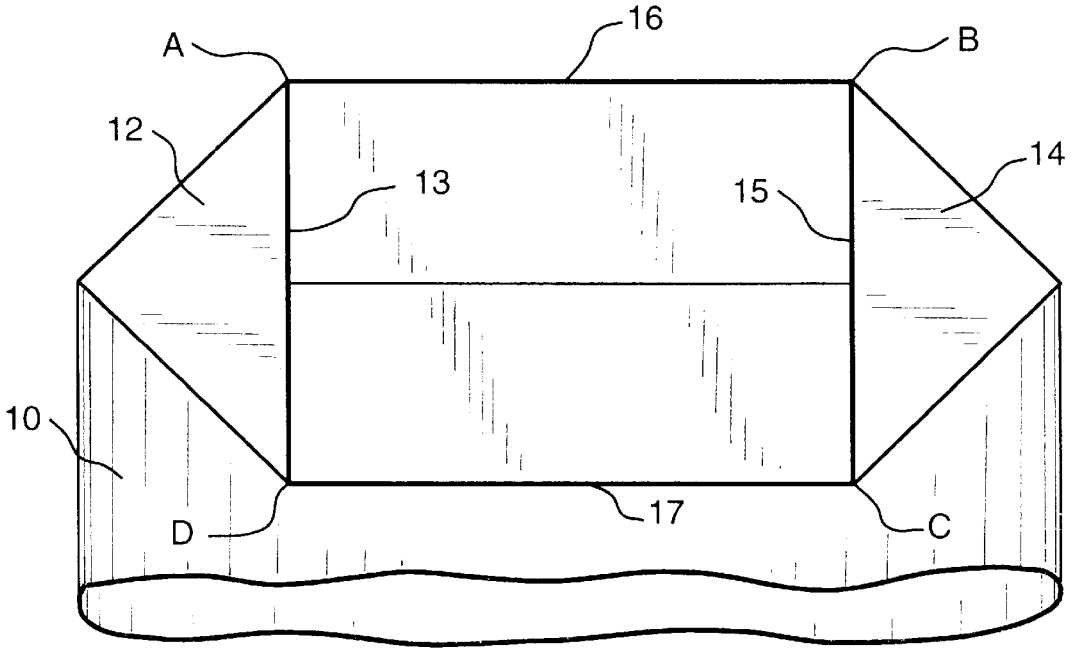
FIG. 1 is a plan view of the upper portion of a partially-folded tube bag in accordance with an embodiment of the present invention.

Referring to the figures, wherein like numbers represent like elements throughout the several drawings, FIG. 1 is a plan view of the upper portion of a partially-folded bag in accordance with an embodiment of the present invention. The bag includes a generally tubular sidewall 10 which may be folded in a manner shown in FIG. 1 to provide inwardly folded corner tucks 12 and 13 at an end of the sidewall 10. Once the corner tucks are inwardly folded, the free edge of the sidewall 10 forms a rectangle defined by the points A, B, C and D. As shown in FIG. 1, the left corner tuck 12 forms a vertically extending free edge 13, while the right corner tuck 14 forms another vertically extending free edge 15. In addition, a horizontally extending free edge 16 extends from point A to point B, while another horizontally extending free edge 17 extends from point D to point C.

Figure 2:
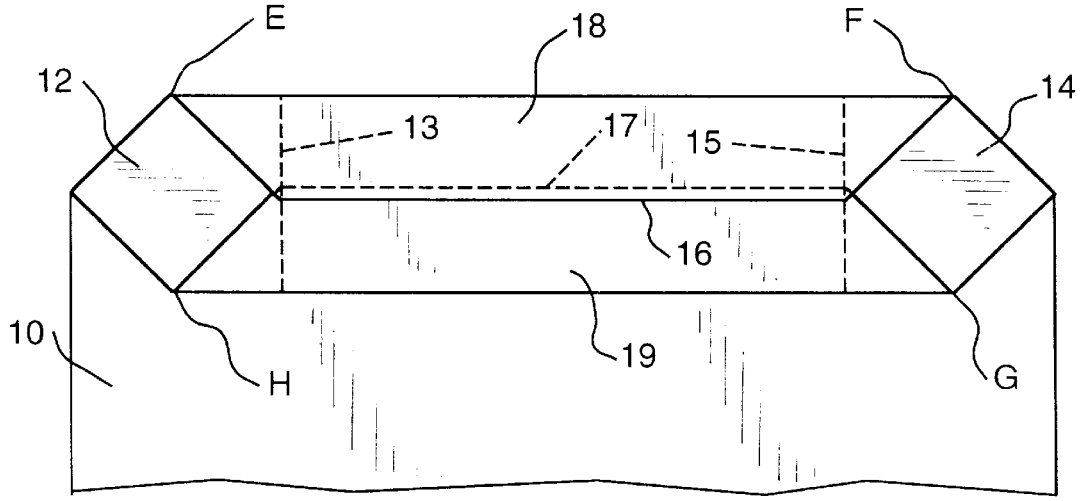
FIG. 2 is a similar plan view showing the upper portion of the tube bag in the fully folded condition.

The partially folded closure shown in FIG. 1 is then folded as shown in FIG. 2 to form overlapping side flaps 18 and 19 over the corner tucks 12 and 14. The sidewall 10 of the bag is thereby provided with a generally rectangular end defined by points E, F, G and H. The overlapping side flaps 18 and 19 are preferably loosely folded over the corner tucks 12 and 14 without the use of adhesives or the like. Thus, the overlapping side flaps may lie loosely adjacent the end tucks without being fastened thereto. While the side flaps 18 and 19 shown in FIG. 2 overlie the corner tucks 12 and 14, the side flaps can alternatively lie underneath the corner tucks.

As shown in FIG. 2, the edges 16 and 17 of the side flaps 18 and 19 overlap each other. This configuration, in combination with the peel-away sheet described below, provides a closure that is easy to open without destroying or tearing the end of the bag. In the preferred embodiment, the peel-away sheet provides a vapor barrier which reduces or eliminates the transfer of water vapor through the closure. For a typical size bag, the edges 16 and 17 preferably overlap each other a distance greater than about 0.2 inch. For example, the edges 16 and 17 of the side flaps 18 and 19 may overlap each other a distance of from about 0.25 to about 1 inch. An overlap of about 0.5 inch is particularly preferred. The overlapping flaps are preferably not secured to each other by any type of adhesive in order to allow the flaps to be easily opened for pouring.

The sidewall 10 of the bag is preferably impermeable to water vapor. A polymeric layer is preferably provided as part of the laminated paper. In addition, the sidewall 10 may include at least one paper layer inside and/or outside of the polymeric sheet. In a preferred embodiment, the sidewall 10 comprises a polymer sheet sandwiched between an inner paper layer and an outer paper layer. For example, the sidewall may comprise a three-layer laminate including an inner layer of brown craft paper, a middle layer of high density polyethylene and an outer layer of bleached craft paper.

Figure 3:
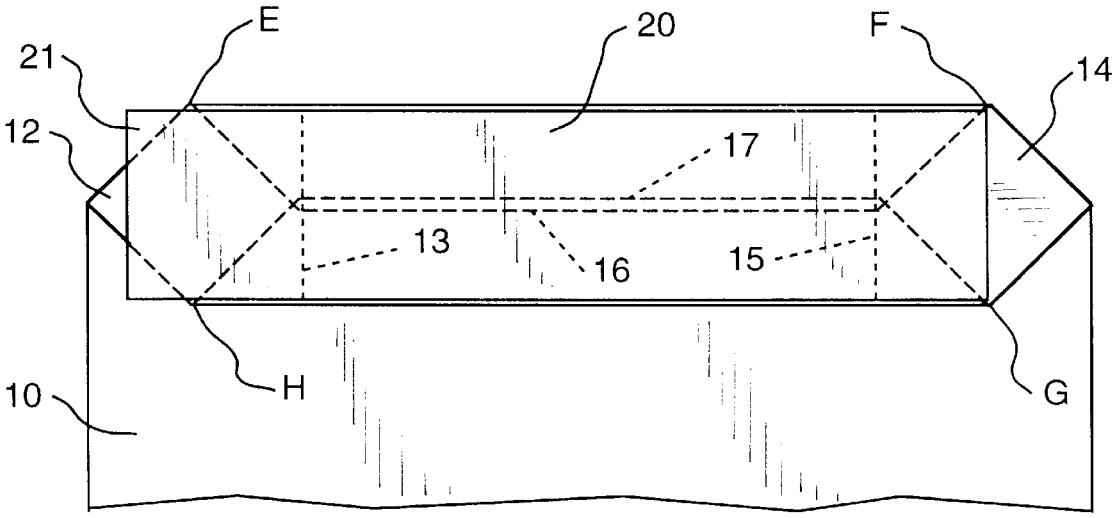
FIG. 3 is a plan view of the upper portion of a bag having a peel-away sheet adhered to loosely folded end flaps of the bag and including a non-adhered tab portion adjacent a corner tuck of the bag in accordance with an embodiment of the present invention.

As shown in FIG. 3, a peel-away sheet 20 is secured to the corner tucks and side flaps. The peel-away sheet 20 is preferably substantially coextensive with the end of the bag defined by the rectangle E, F, G and H. Such a substantially coextensive peel-away sheet 20 provides a secure closure which prevents leakage from the bag during storage, and which may also substantially eliminate the penetration of water vapor through the closure.

The peel-away sheet 20 preferably includes a graspable tab portion 21 which extends from the corner tuck 12. The peel-away sheet 20 is preferably secured to the corner tucks and side flaps by a suitable adhesive which allows the sheet to be at least partially removed from the corner tuck and side flaps. The adhesive preferably covers the entire surface of the peel-away sheet which is in contact with the corner tucks and side flaps. Thus, adhesive may be applied to the contact surface of the peel-away sheet 20 in the area generally defined by the points E, F, G and H in FIG. 3. The tab portion 21 of the peel-away sheet 20 preferably is free of adhesive in order to facilitate grasping and peeling of the sheet 20 away from the adjacent corner tuck 12 and side flaps. The peel-away sheet 20 preferably comprises a material which is impermeable to water vapor, such as laminated paper having a density of about 145 g/m$^2$.

Figure 4:
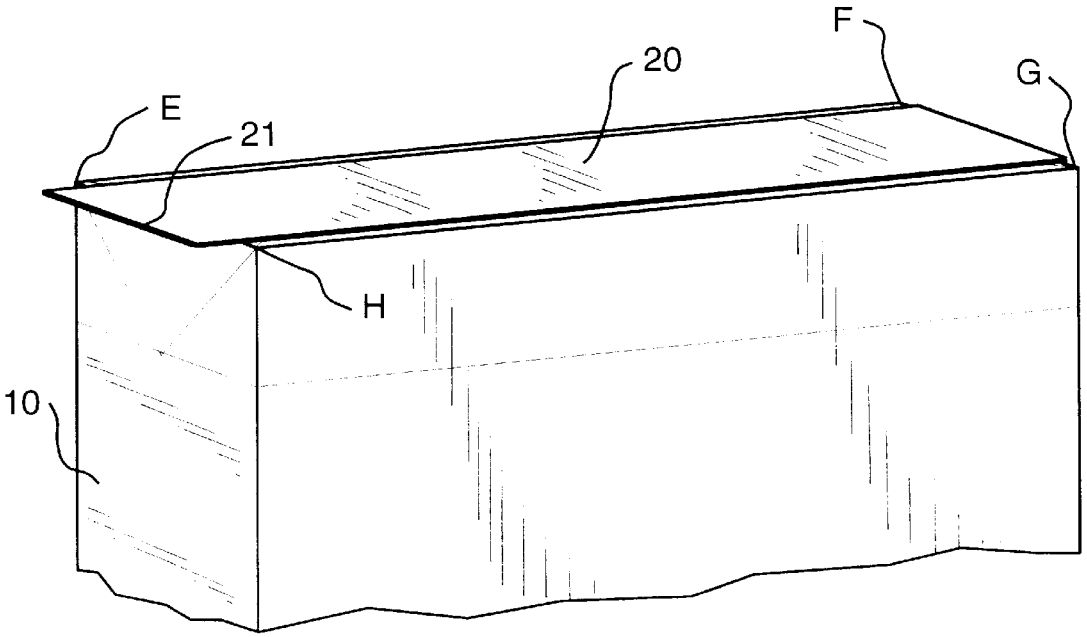
FIG. 4 is a perspective view of a bag closure in accordance with an embodiment of the present invention.
Figure 5:
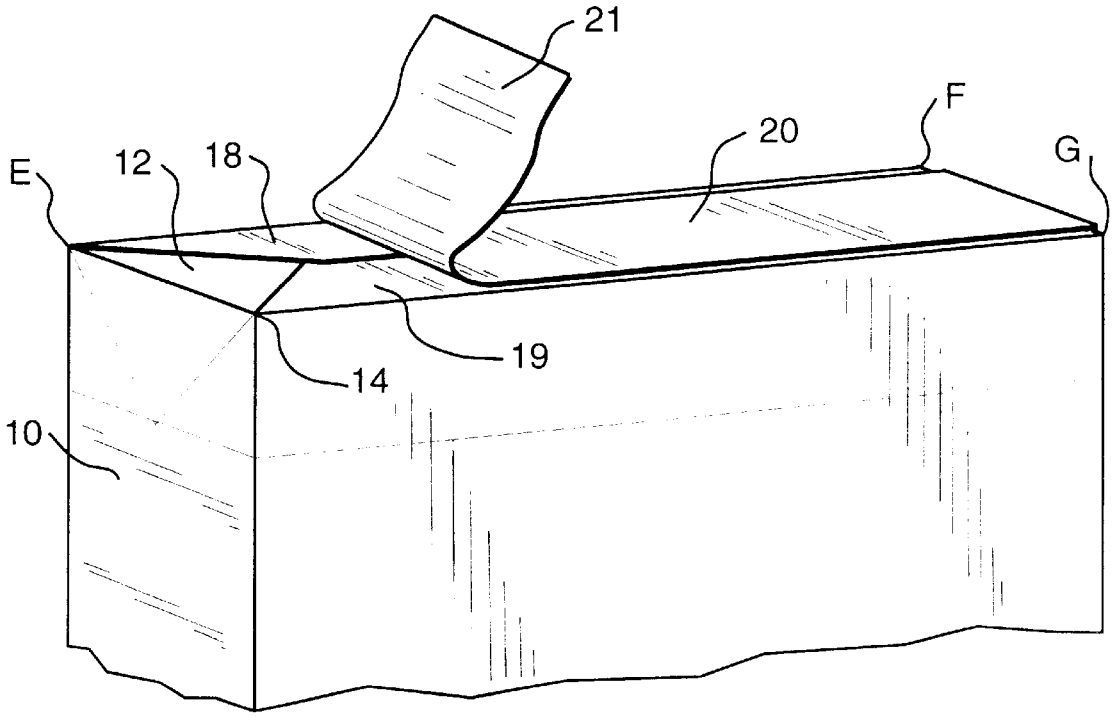
FIG. 5 is a similar perspective view showing the peel-away sheet peeled away from the loosely folded end flaps of the bag in accordance with the present invention.
Figure 6:
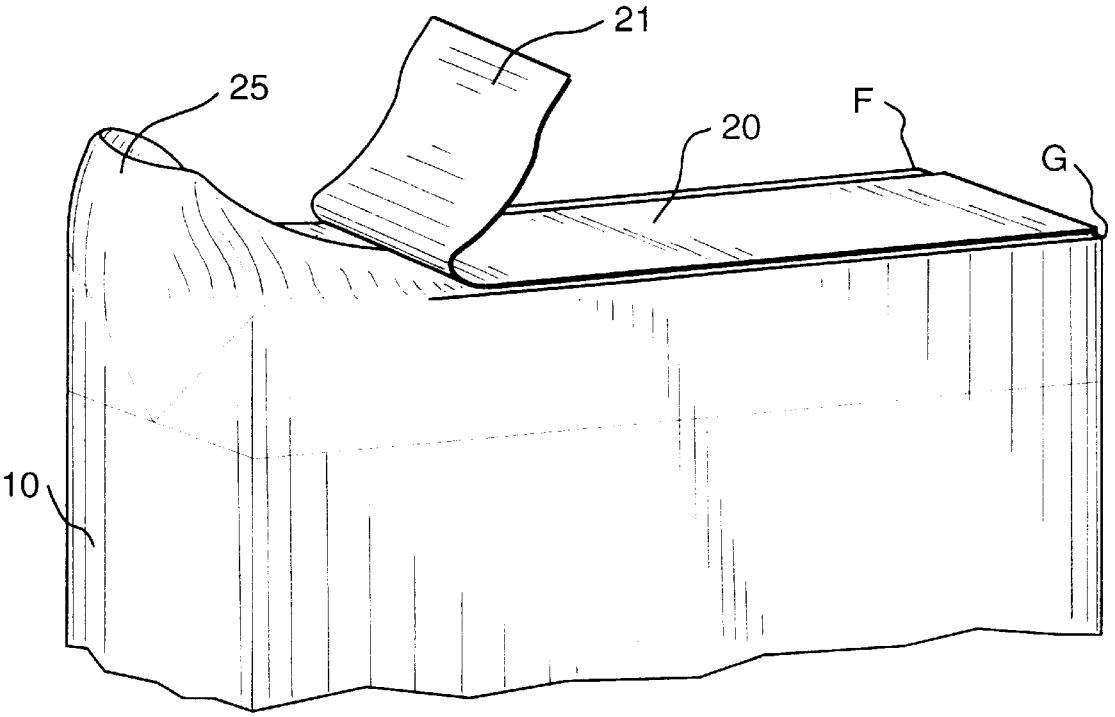
FIG. 6 is a similar perspective view showing the peel-away sheet peeled away and a corner tuck of the bag unfolded to form a pour spout in accordance with the present invention.

As shown in FIG. 4, after the peel-away sheet 20 has been applied to the inwardly folded corner tucks and side flaps, a generally rectangular end closure is formed, as defined by the points E, F, G and H. The graspable tab portion 21 of the peel-away sheet 20 extends away from the edge of the closure defined by the line E-H. In order to open the bag, the tab 21 may be grasped and peeled away from the adjacent corner tuck 12 and side flaps 18 and 19, as shown in FIG. 5. Once the peel-away sheet 20 has been pulled back a sufficient distance, the corner tuck 12 and portions of the side flaps 18 and 19 are exposed. Since the side flaps 18 and 19 are loosely folded over the corner tuck 12, they can easily be unfolded in order to provide an opening in the bag. As shown in FIG. 6, by pulling the corner tuck 12 outward away from the side flaps 18 and 19, a pour spout 25 is formed which facilitates emptying of the contents of the bag. The bag may be closed again by simply rolling the upper portion of the bag shut. Alternatively, the peel-away sheet 20 may be provided with a resealable adhesive which allows the sheet to be reattached to the corner tuck 12 and side flaps 18 and 19.

In accordance with a preferred embodiment, the bag holds moisture sensitive materials such as cementitious underlayments, toppings, mortars and grouts. Such materials, which are typically provided in dry powder form, must not be exposed to excessive amounts of moisture during handling and storage. The bag may be filled with such materials through a valve opening which is then closed.

In accordance with the preferred embodiment, the peel-away bag closure substantially eliminates water penetration by providing a barrier sheet which is substantially impermeable to water vapor over the end of the bag. The vapor barrier sheet is securely fastened to the corner tucks and side flaps of the bag during storage, but can be easily peeled away in order to allow the contents to be poured from the bag. This configuration eliminates the need for conventional pull string or sewn ends which do not adequately prevent moisture penetration.

While not shown in the figures, the bottom portion of the bag may be of any suitable construction. For example, the bottom closure may be similar to the top closure, either with or without a graspable tab portion. Alternatively, the bottom closure of the bag may include a tubular spout or valve of conventional design. In this case, the spout or valve is preferably covered by a vapor barrier sheet similar to that of the preferred top closure in order to prevent water vapor penetration. While the peel-away sheet of the present invention is located at the top end of the bag in FIGS. 1–6, it is to be understood that the closure can also be located at the bottom of the bag.

Although particular embodiments of the present invention have been described above for purposes of illustration, it will be evident to those skilled in the art that numerous variations, modifications and adaptations may be made without departing from the scope of the invention as defined in the appended claims.

What is claimed is:

1. A bag containing a flowable material, the bag comprising:

a tubular sidewall;

a pair of oppositely disposed inwardly folded corner tucks at an end of the sidewall;

a pair of oppositely disposed inwardly folded overlapping side flaps at the end of the sidewall lying adjacent the corner tucks;

a flowable material contained in the bag; and peel-away sheet means removably secured to the corner tucks and side flaps and including a graspable tab portion adjacent one of the corner tucks for allowing the tab portion to be grasped and peeled away from the adjacent corner tuck to allow the adjacent corner tuck to be unfolded to open the bag and to allow the flowable material to be removed from the bag while a portion of the peel-away sheet means remains secured to at least a portion of each of the side flaps.

2. The bag of claim 1, wherein the tubular sidewall comprises at least one layer of substantially moisture impermeable material.

3. The bag of claim 1, wherein the overlapping side flaps are loosely folded over the corner tucks.

4. The bag of claim 1, wherein the overlapping side flaps overlap each other a distance greater than about 0.2 inch.

5. The bag of claim 1, wherein the overlapping side flaps overlap each other a distance of from about 0.25 to about 1 inch.

6. The bag of claim 1, wherein the peel-away sheet is substantially impermeable to water vapor and forms a vapor barrier closure.

7. The bag of claim 1, wherein the peel-away sheet is removably secured to the corner tucks and side flaps by adhesive.

8. The bag of claim 7, wherein the adhesive covers substantially the entire surface of the peel-away sheet which is in contact with the corner tucks and side flaps.

9. The bag of claim 1, wherein the peel-away sheet is substantially coextensive with the corner tucks and side flaps.

10. The bag of claim 1, wherein the peel-away sheet comprises laminated paper.

11. The bag of claim 1, wherein the peel-away sheet is resealable to the corner tucks and side flaps.

12. The bag of claim 1, wherein the graspable tab portion comprises an extension of the peel-away sheet which extends from the adjacent corner tuck.

13. The bag of claim 1, wherein the corner tucks, overlapping side flaps and peel-away sheet are located at a top end of the bag.

14. A bag closure and bag containing a flowable material comprising:

a bag containing a flowable material;

an inwardly folded corner tuck at an end of the bag;

a pair of oppositely disposed inwardly folded overlapping side flaps at the end of the bag lying loosely adjacent the corner tuck;

peel-away sheet means removably secured to the corner tuck and side flaps and including tab means extending from the corner tuck for opening the bag closure upon grasping the tab means and peeling the peel-away sheet means away from the corner tuck to allow the flowable material to be removed from the bag while a portion of the peel-away sheet means remains secured to at least a portion of both of the side flaps.

15. The bag closure of claim 14 wherein the overlapping side flaps are folded over the corner tuck.

16. The bag closure of claim 14, wherein the overlapping side flaps overlap each other a distance greater than about 0.2 inch.

17. The bag closure of claim 14, wherein the overlapping side flaps overlap each other a distance of from about 0.25 to about 1 inch.

18. The bag closure of claim 14, wherein the peel-away sheet is substantially impermeable to water vapor.

19. The bag closure of claim 14, wherein the peel-away sheet is removably secured to the corner tucks and side flaps by adhesive.

20. The bag closure of claim 14, wherein the adhesive covers substantially the entire surface of the peel-away sheet which is in contact with the corner tuck and side flaps.

21. The bag closure of claim 14, wherein the peel-away sheet is substantially coextensive with the corner tuck and side flaps.

22. The bag closure of claim 14, wherein the peel-away sheet comprises laminated paper.

23. The bag closure of claim 14, wherein the peel-away sheet is resealable to the corner tuck and side flaps.

24. The bag closure of claim 14, wherein the graspable tab portion comprises an extension of the peel-away sheet which extends from the adjacent corner tuck.

25. The bag closure of claim 14, wherein the corner tuck, overlapping side flaps and peel-away sheet are located at a top end of the bag.

26. A bag containing a flowable material, the bag comprising:

a tubular sidewall;

a pair of oppositely disposed inwardly folded corner tucks at an end of the sidewall;

a pair of oppositely disposed inwardly folded overlapping side flaps at the end of the sidewall lying adjacent the corner tucks;

a flowable material contained in the bag; and peel-away sheet means removably secured to the corner tucks and side flaps and including a graspable tab portion adjacent to and extending from one of the corner tucks for allowing the tab portion to be grasped and peeled away from the adjacent corner tuck to allow the adjacent corner tuck to be unfolded to open the bag and to allow the flowable material to be removed from the bag while a portion of the peel-away sheet means remains secured to at least a portion of both of the side flaps.

* * * * *